United States Patent [19]

Girgis et al.

[11] Patent Number: 4,663,231

[45] Date of Patent: May 5, 1987

[54] FLEXIBLE, CHEMICALLY TREATED FIBERS AND COATED FABRICS THEREOF

[75] Inventors: Mikhail M. Girgis, Pittsburgh; Ernest L. Lawton, Allison Park, both of Pa.

[73] Assignee: PPG Industries, Inc., Pittsburgh, Pa.

[21] Appl. No.: 865,596

[22] Filed: May 22, 1986

Related U.S. Application Data

[63] Continuation of Ser. No. 635,086, Jul. 27, 1984, abandoned.

[51] Int. Cl.[4] ..... D02G 3/00

[52] U.S. Cl. ..... 428/378; 428/375; 428/391; 428/392; 428/394; 428/395; 65/3.41; 65/3.43; 65/3.44

[58] Field of Search ..... 428/375, 378, 391, 392, 428/394, 395; 65/3.41, 3.43, 3.44

[56] References Cited

U.S. PATENT DOCUMENTS

| | | | |
|---|---|---|---|
| 3,318,757 | 5/1967 | Atwell | 65/3.41 |
| 3,432,332 | 3/1969 | Marzocchi et al. | 428/378 |
| 3,650,818 | 3/1972 | Marzocchi et al. | 117/126 |
| 3,740,263 | 6/1973 | Kochhar et al. | 428/378 |
| 3,869,308 | 3/1975 | Graham | 117/126 |
| 3,924,028 | 12/1975 | Benson et al. | 427/175 |
| 4,147,555 | 4/1979 | Cohen et al. | 428/378 |
| 4,178,412 | 12/1979 | Sage et al. | 428/391 |
| 4,264,655 | 4/1981 | Brook | 427/389.8 |
| 4,272,294 | 6/1981 | Jaunarajas | 428/389 |
| 4,295,871 | 10/1981 | Droux et al. | 65/3.41 |
| 4,390,647 | 6/1983 | Girgis | 65/3.44 |
| 4,405,746 | 9/1983 | Girgis | 428/378 |
| 4,450,197 | 5/1984 | Hager et al. | 428/232 |

FOREIGN PATENT DOCUMENTS 68678 6/1976 Japan .

OTHER PUBLICATIONS

"A Fourier Transform Infra-Red Study of the Phase Behaviour of Polymer Blends. Ethylene-Vinyl Acetate Copolymer Blends with Poly(Vinyl Chloride) and Chlorinated Polyethylene", Polymer, 1983, vol. 24, pp. 1410-1414.

"Investigation of the Effect of Coatings on the Failure Mechanism of Fiberglass Yarn in Tubular Reverse Osmosis", Nat'l. Technical Info. Service, Sep. 1973, pp. 5-8, 25-29, 32-37, 47 and 52-53.

"High Performance Coated Fabrics of Kevlar® Aramid Fiber", Journal of Coated Fabrics, vol. 7, (Jul. 1977), pp. 3-23.

"Architectural PTFE-Coated Glass Fabrics—Their Structure and Limitations", School of Materials Science, University of Bath, Claverton Down, Bath, England, Textile Research Journal, pp. 692-700.

"Utilization of Vinyl Coated Fabrics in Industrial Applications", Richard N. Seaman and Balakrishnan Venkataraman, Journal of Coated Fabrics, (vol. 5), Apr. 1976.

*Primary Examiner*—Lorraine T. Kendell
*Assistant Examiner*—S. A. Gibson
*Attorney, Agent, or Firm*—Kenneth J. Stachel

[57] ABSTRACT

Coated fabrics produced with more flexible bundles of filaments are possible with the flexible bundle of filaments of the present invention. The flexible bundle of filaments comprise a plurality of sized filaments having the moisture-reduced partially cured coating and impregnant of an aqueous chemical coating composition. The composition has a vinyl-containing interpolymer with one or more comonomers and a self-crosslinking polymeric material and water. Optionally, there may be present one or more aqueous emulsifiable or dispersible waxes, aqueous dispersible or emulsifiable plasticizers and/or one or more aqueous dispersible or emulsifiable diene-containing elastomers. The diene-containing elastomer is always present when the comonomer of the ethylene-containing interpolymer tends to decrease the noncrystallinity of the interpolymer or increase the glass transition temperature of the interpolymer.

31 Claims, 1 Drawing Figure

FLEXIBLE, CHEMICALLY TREATED FIBERS AND COATED FABRICS THEREOF

This application is a continuation of application Ser. No. 635,086, filed July 27, 1984 now abandoned.

The present invention is directed to chemically treated bundles of fibers such as strands or yarns which can be woven, where the woven fabric finds particular application in being coated or laminated with polymeric films.

Chemically coated textile fabrics are manufactured by coating or laminating polymeric film to a textile fabric substrate and they are used in a wide variety of products. Early coated fabrics were cotton fibers with coatings of wax, oil, or natural rubber that were applied to render the material waterproof. With the advent of synthetic polymers, the polymeric film applied to the textile fabrics included polyvinyl chloride, polyurethane, silicones, polytetrafluoroethylene, polyethylene, chlorosulfonated polyethylene, chlorinated polyethylene polymers of ethylene propylene diene monomer, neoprene and synthetic rubbers such as Hypalon® rubber and nitrile rubber. Along with the development of various polymeric films, the fibrous material comprising the textile fabric was also revolutionized to include such fibers as polyesters, polyamides such as nylon, aramid fibers such as Kevlar® fibers, rayon, graphite, and glass fibers and other organic and inorganic man made fibers.

The coated textile fabrics have found a wide range of applications from architectural and building applications to industrial and commercial fabric applications and to geotextile applications. A few building applications include air and tension structures like tension and/or air supported covers for athletic stadiums and airport facilities like the tent-roof 425,000 square meter coated fabric roof of an airport facility and the 26,000 square meter air-supported coated fabric roof for an athletic stadium, while a few industrial and commercial applications include reservoir, pool, pond and waste site covers and liners, awnings and tarpaulins, and a few geotextile applications include road repair systems and other civil engineering applications. In these ranges of various applications, many of the applications have common performance requirements of the coated fabrics while some of the applications also demand specific performance requirements of the coated fabrics. The performance requirements are met by both individual and amalgamated contributions of the uncoated textile fabric and polymeric film coating. The performance requirements demanded from the textile fabric include high tensile strength, good flexibility, good weatherability, good chemical resistance, high tear strength, resistance to tear propogation, good dimensional stability to minimize stretch under load, good stability under various temperature and humidity conditions, good abrasion, and good adhesion to the polymeric film. Another useful property of the coated fabrics, especially for structure and building applications is good flame resistance.

Some fibrous materials that can be used for polymeric coated textile fabrics may be deficient in one or more of the desired performance properties. For instance, inorganic fibers such as glass fibers, have good dimensional stability, are nonflammable, and have a good stiffness, but they lack the requisite flexibility, abrasion resistance and adhesion to the polymeric film used to coat or laminate the textile fabric. In addition, when glass fibers are used in preparing the fabric for the coated fabrics, greige goods have traditionally been used. In producing glass fibers, ordinarily an aqueous chemical treating composition is applied to the filaments as they are attenuated from molten streams of glass issuing from a bushing of a glass melting furnace. The filaments are then gathered into strands and the strands either twisted or untwisted are prepared into yarns. The greige goods are prepared by weaving the glass fiber yarns and heat cleaning the yarns to remove the chemistry of the sizing composition. The heat cleaning of the glass fiber yarn may reduce some of the strength properties inherent in the glass fibers, and, thereby, detract from the strength properties of the glass fiber fabric. The deficiencies of the glass fibers may not be assuaged by formulating composite strands including various types of organic textile materials with the glass fibers. The fiberous materials and polymeric films are used to produce coated fabrics typically having a thickness of around 1 millimeter with a total mass per unit area in excess of about 750 grams per square meter. The polymeric film in the coated fabrics serves to impart air tightness, color and protection from abrasive wear to the basic fabric. Even with the organic fibrous materials used in the fabric, the chemical bonding between the coating and the fabric is not very strong despite the inclusion of fabric-adhesion promoters in the polymeric formulation comprising the film.

It is an object of the present invention to provide fibrous materials having improved flexibility and abrasion resistance to result in improved coated or laminated fabric products.

It is an additional object of the present invention to provide fibrous materials having improved flexibility and abrasion resistance to result in improved woven and unwoven fabrics which can be manufactured into coated fabric products without requiring heat treatment of the fibrous materials or fabric.

SUMMARY OF THE INVENTION

Accordingly, the aforementioned objects and other objects gleaned from the following disclosure are accomplished by the bundles of sized filaments coated and impregnated with the moisture reduced, partially cured residue of an aqueous chemical treating composition. The aqueous chemical treating composition has an aqueous soluble, dispersible or emulsifiable elastomeric ethylene-containing interpolymer such as a copolymer or terpolymer formed from ethylene monomer and one or more polar comonomers and a water soluble, dispersible or emulsifiable crosslinkable polymeric material. The ethylene-containing interpolymer has a glass transition temperature of at least as low as around 0° C. and has sufficient ethylene segments to achieve the desired glass transition temperature and has one or more polar comonomers which result in an essentially noncrystalline (amorphous) copolymer or terpolymer. The interpolymer comprises the major portion of the solids of the aqueous chemical treating composition. Water is present in the composition in a predominant amount so that the total solids and the viscosity are effective for impregnating the bundle of filaments. The impregnation is to such a degree so that the moisture reduced, partially cured residue of the aqueous impregnant composition is present on a substantial portion of a majority of the filaments in the bundle so that a majority of the filaments are separated to some extent from each other.

The crosslinkable material is present in the aqueous chemical treatment in an amount that is effective to engender a partial cure of the moisture reduced residue of the coating to provide a substantially nontacky external surface of the coated and impregnated bundle of filaments.

Optionally included in the aqueous chemical coating composition are water soluble, emulsifiable or dispersible waxes, plasticizers and diene-containing elastomers and crosslinking controlling agents. The diene-containing elastomeric latex is ordinarily present as an optional constituent, except when the polar comonomer for the ethylene-containing interpolymer is a comonomer which tends to co-crystallize with the polyethylene crystal structure. In this case, the diene-containing elastomer must be present in at least a minor portion of the solids of the coating composition. The diene-containing elastomer is essentially free of vinyl pyrridine.

The aqueous chemical treating composition is present to impregnate the bundle of filaments, where the filaments have a dried residue of an aqueous sizing composition. In the process of forming filaments, the aqueous sizing composition is applied to protect the filaments from interfilament damage, and, if necessary, it renders the surface of the filament less hydrophilic to be more compatible with hydrophobic coatings.

The impregnated bundle of filaments alone or in combination with other bundles of filaments has sufficient flexibility for weaving of the bundle or bundles into a fabric. The fabric can then be coated to produce coated fabrics by processes such as impregnation, saturation processes, and surface coating processes like solvent-containing coatings, or plastisols and lamination with preformed films or sheets of the coating polymeric materials.

DETAILED DESCRIPTION OF THE INVENTION

Figure 1:
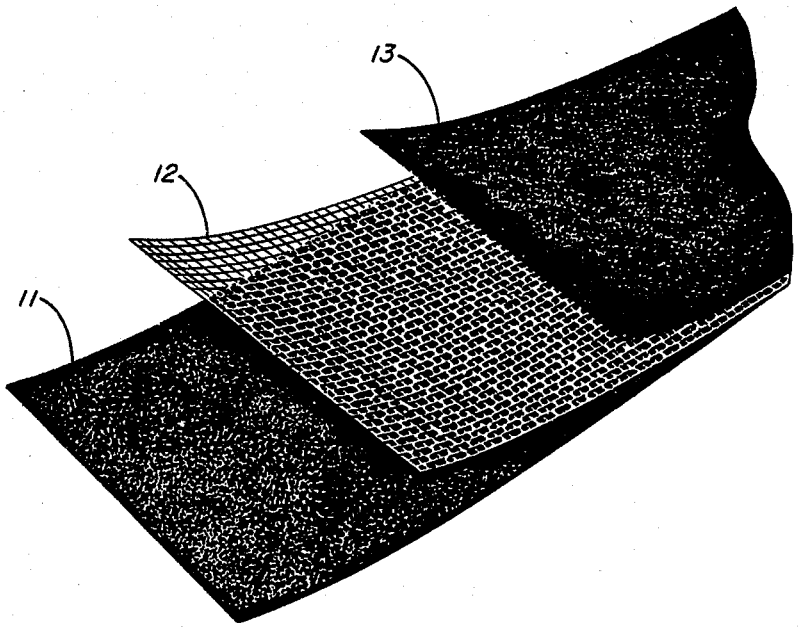
FIG. 1 depicts the coated fabric showing the laminated sheets or films used in conjunction with the fabric.

Bundles of filaments, strands, rovings and bundles of strands and yarns both twisted and untwisted that are flexible enough to be woven can be produced according to the present invention without the need for heat cleaning the bundles to remove chemical treatments. Ordinarily when glass filaments are produced usually as continuous filaments, the filaments are treated with a sizing composition which has chemical components to protect the filaments from interfilament rubbing and friction and from friction and rubbing developed in processing the filaments over various contact points and guide eyes. In weaving fabric or cloth from the continuous fibers or group of fibers as strands or group of strands or yarn, the length-wise running yarns in the woven fabric or warp yarn can be subjected to considerable abrasion from the moving parts of the weaving loom. Abrasion to the warp yarn can result from guide surfaces of split rods, drop wires, confuser bars, heddles, reeds, shuttles and adjacent yarns in the loom. To protect the warp yarn from such abrasion, a slashing chemical composition is usually applied. Once the fabric is woven, the fabric has the warp yarn that has present a sizing composition present on the filaments from their formation and a slashing sizing composition, while the weft yarn in the fabric has present only the forming sizing composition. The additional coating of the slashing size on the warp yarn would result in different surface properties between the warp and weft yarns in the same fabric. Such differences would cause imperfections in drying of the fabrics or in the handle and feel of the fabrics or in the electrical and reinforcement properties of the fabrics used with polymeric coatings. Therefore, the fabrics are usually heat cleaned to remove both the forming and slashing sizing compositions and to set the yarns in the fabric. For example, with glass fiber strand yarn fabrics, this heating is usually conducted at temperatures of around 900° to 1300° F. (482° to 705° C.) for around 10 to 180 seconds or longer to volatilize the solids and remove them from the fabric and to soften the glass fibers in the fabric to set them in their new positions. Glass fiber strands ordinarily have high tensile strength, dimensional stability and resistance to chemical, photochemical and microbiological degradation but the heat treating process reduces somewhat the strength properties of the glass fiber strands.

Filaments such as polyester and nylon and Kevlar® polyamides have been used to make fabrics which can subsequently be coated with a polymeric film or laminate. The glass fiber strand yarns do not have the flex fatigue properties and the lighter density of the polyester and polyamide yarns. A more flexible bundle of filaments, particularly glass filaments, strands and yarns and even polyesters and polyamides are provided by the impregnated bundle of filaments of the present invention. The impregnated bundle of filaments has improved breaking strengths and flex fatigue resistance and the bundle maintains these properties under humidity and water aging and also provides good adhesion to the polymeric film coating matrix.

The bundles of sized filaments of the present invention have an impregnant of a moisture-reduced, partially cured residue of an aqueous impregnant composition. The aqueous coating has a predominant amount of the solids comprised of an elastomeric ethylene-containing interpolymer. The interpolymer, which is usually a copolymer or terpolymer, is formed from ethylene monomer and one or more polar comonomers, where the comonomer may vary from co-crystallizing with the polyethylene crystal structure or resulting in an essentially noncrystalline (amorphous) interpolymer. Nonexclusive examples of these polar comonomers include: vinyl acetate, methyl acrylic acid, ethyl acrylic acid, styrene, alpha methyl styrene, methyl methacrylic acid, acrylamide, methyacrylic acid, n-methyl-n-vinyl acetamide, diethyl fumarate, diethyl maleate, n-vinyl pyrrolidone, n-vinyl succinimide and the like and mixtures thereof. The interpolymer has a ratio of the ethylene to the polar comonomers sufficient to have a glass transition temperature (Tg) of around 0° C. or less. The glass transition temperature can be determined by any method known to those skilled in the art, examples of which include nuclear magnetic resonance peak ratio or by approximation by less complicated techniques such as differential thermal analysis. The interpolymers should be uniform interpolymers rather than nonuniform or alternating copolymers or terpolymers although the latter two types may be used to a limited extent. The uniform interpolymers are those that are formed either from two or more monomers having equal reactivities polymerized to any conversion percent or by limiting the percent conversion during interpolymerization to a low percent conversions when the monomers have different reactivities so that the comonomer concentration is kept almost constant. The nonuniform copolymers and alternating copolymers are those known to those skilled in the art. The interpolymers are also water soluble, emulsifiable or dispersible with the use of suitable emulsifiers and/or solvents. The interpolymers can be produced by any method known to those skilled in the ethylene copolymer art. A particularly useful elastomeric ethylene-containing interpolymer is an ethylene vinyl acetate copolymer having the vinyl acetate monomer present in the copolymer in an amount in a range of around 25 mole percent or greater or about 45 to 80 weight percent of the copolymer. The copolymer also has a sufficient amount of ethylene comonomer to give a Tg for the ethylene vinyl acetate copolymer of 0° C. or less. A nonexclusive example of such an ethylene vinyl acetate copolymer is that commercially available from Air Products and Chemicals, Inc. in an emulsion form under the trade designation Airflex ® 410 vinyl acetate/ethylene copolymer emulsion. This material has the copolymer formula of $A_x$-$B_y$ where A is equal to $C_4H_6O_2$ and B is equal to $C_2H_4$. The appearance of the emulsion is a white mobile liquid having a viscosity of 100 to 2,000 as measured by Brookfield viscosimeter, Model LVF (No. 2 or No. 3 spindle at 60 rpm and at 77° F). Also the emulsion has a pH of 4 to 7 and a percent volatiles by volume of 45 to 53 and a specific gravity of 1.1 and a density of 9 pounds per gallon. The dispersion has very small polymer particles in water and contains formaldehyde at concentrations of up to 0.1 percent by weight with no other photochemically-reactive solvents or reactive chemical solvents added. The residual unpolymerized monomer levels are less than 0.5 percent of the total product. The amount of the ethylene-containing interpolymer present in the aqueous impregnant composition is an effective film forming amount for impregnating the bundle of filaments to produce a near continuous film on a substantial portion of the surfaces of the filaments in the bundle of filaments. Also the amount may be effective to form a film on the bundle of filaments. Generally, the amount is a predomiant amount of the solids of the aqueous impregnant composition.

The aqueous chemical impregnating composition in addition to the ethylene-containing interpolymer has one or more crosslinkable materials. Suitable crosslinking materials are chemical compounds, monomers, oligomers and resinous type polymers all of which are at least self-crosslinkable at ambient or elevated temperatures and at atmospheric or sub or super-atmospheric pressures. By self-crosslinkable, it is meant that the material need not crosslink with the ethylene-containing interpolymer. The polymeric crosslinking materials may be self-crosslinkable through external chemical compounds or through internal crosslinking. By externally crosslinkable, it is meant that crosslinking agents known by those skilled in the art for particular resinous polymers can be used to crosslink the polymer. Resinous polymers include such polymers as epoxies, methylol-condensate polymers, polyurethanes, polyesters and other polymers that are not rubber polymers as are butadiene, isobutylene, styrene-butadiene-vinyl-pyrridine terpolymers and styrene-butadiene copolymers and the like. Nonexclusive examples of the crosslinkable materials include the aldehyde condensate polymers such as melamine formaldehyde, hexakis/methylol-containing condensates, monomers, dimers, trimers and higher oligomers, where for the phenol or resorcinol, compounds include cresol and mixtures of its isomers, xylenol or mixtures of its isomers, a mixture of homologs of phenol and dihydric phenols such as phlorglucinol, resorcinol, cresorcinol, and meta-xylorcinol can be used. The aldehyde includes any methylene donor that can be used in lieu of formaldehyde, for example, paraformaldehyde, hexamethylene-tetramine, acid aldehyde, furfural and mixtures thereof. The aldehyde or methylol condensates can be used in conjunction with acid or basic catalysts. Also internal curing may also occur as the result of removal of a stabilizing ingredient. For example, polyvalent metal ions can be stabilized by the addition of volatile complexing agents. When the impregnant is appplied, these agents evaporate, allowing the metal to bond at two or more sites on the polymer resulting in a crosslinked coating. An example of this would be the use of zinc or zirconium salts which are stabilized by the addition of excess ammonia. When an impregnant is applied, the ammonia evaporates resulting in a flexible crosslinked impregnant. This same principle can be used to inactivate a catalyst. For example, toluene sulfonic acid which is used to catalyze curing with urea-formaldehyde resins can be inactivated with a volatile amine. When the impregnant is applied the amine-acid complex is decomposed through volatilization of amine and the coating is cured. It is preferred to have one or more melamine formaldehyde resins because of their ease in crosslinking and their compatibility with the ethylene-containing interpolymer. A particularly suitable melamine formaldehyde resin is the aqueous melamine formaldehyde resin available from Monsanto Company under the trade designation Resimene 841 which has less than two percent free formaldehyde and less than 5 percent methanol and has a boiling point of 210° F. The Resimene 841 also has a vapor pressure of 95 for methanol and 17.5 for water, a vapor density of 1.11 for methanol and 0.64 for water, a colorless, clear mobile liquid appearance, specific gravity at 77° F. of 1.25 and a percent volatile by volume percent of 29.

The amount of the crosslinkable material used in the aqueous impregnant composition is an effective amount to produce at least partial curing of the moisture reduced residue of the aqueous impregnating composition. The partial curing controls the surface tack of the moisture-reduced residue of the impregnant to enable a nearly uniform payout of the impregnated bundle of filaments from wound packages, where the bundle of filaments is comprised of larger diameter filaments, the partial curing by crosslinking can be reduced. Where the bundle of filaments has the finer diameter filaments, the partial curing can be increased from that for larger diameter filaments. Where the impregnated bundles of filaments are packed more densely on a wound package, the bundles will be more tack sensitive and a higher degree of partial curing through crosslinking is desirable. With such a controlled surface tack characteristic, the bundle of filaments impregnated with the aqueous impregnant composition in a moisture-reduced state can be processed on weaving looms without the use of loom feeders. Although if loom feeders are available, the partial curing can be reduced so that surface tackiness is not controlled as stringently. Preferably, the partial curing results in a hardness or modulus of the moisture-reduced residue of the aqueous impregnant composition impregnating the bundle of filaments so that the flexibility of the impregnated bundles of filaments has at least a two-fold improvement in flexibility. The improved flexibility is over a similarly constructed, unimpregnated bundle of filaments. In addition, the partial curing permits further curing of the moisture-reduced residue of the aqueous impregnant composition impregnating the bundle of filaments. The further curing provides chiefly for external adhesion between the bundles of filaments and the polymeric film coating that subsequently will be applied to the fabric of impregnated bundles of filaments. Also some further additional internal adhesion may be provided to increase further the integrity of the bundle of filaments already provided through partial curing. An upper limit on the extent of partial curing through crosslinking is in order that the flexibility of the impregnated bundle of filaments is not reduced below the flexibility of unimpregnated bundles of filaments.

In addition to the crosslinkable material, the aqueous impregnant composition can have a crosslinking controlling agent to control the degree of crosslinking of the self-crosslinkable material and possibly between the self-crosslinkable material and the ethylene-containing interpolymer. The crosslinking controlling agent can be one which modifies the pH of the coating composition such as ammonium hydroxide, or can be one such as an acid catalyst for the crosslinkable material. A nonexclusive example of the latter is a solution of toluene sulfonic acid in isopropanol such as that available under the trade designation Cycat 4040 with 40 percent acid and 60 percent alcohol available from American Cyanamide Co. In addition, in the absence of a crosslinking controlling agent, one of the monomers in the ethylene-containing interpolymers can provide for a less tacky film coating by its concentration in the interpolymer to increase the softening point of the interpolymer. Also the crosslinking controlling agent may assist in controlling the hardness or modulus of the film of the coating. The amount of the crosslinking controlling agent used in the aqueous impregnant composition will vary depending on the strength of controlling agent, but the amount is gauged in conjunction with the amount of the crosslinkable material to achieve partial curing of the residue of the aqueous impregnant composition.

The water in the aqueous chemical treating composition constitutes a predominant amount of the composition including both the volatile and the nonvolatile portions. The amount of water results in a total solids concentration and viscosity for the composition that enables the composition to impregnate the bundle of filaments including bundles of strands and yarn. The degree of impregnation of the bundle of filaments is such that a majority of the filaments have a substantial portion of their surfaces covered with a near continuous film of the residue of the aqueous impregnant composition so that a majority of the filaments are separated from each other. It is not necessary that the bundle is encapsulated, although it may be as long as it is also impregnated. Preferably, where the ethylene-containing interpolymer is present as an emulsion or dispersion having a solids content of around 50 percent, the viscosity of the aqueous impregnant composition is around 5 or less for a kiss roll type coating application and up to around 10±5 centipoise at room temperature for a die coating process. The total solids of the aqueous impregnant composition varies depending upon the diameter of the filaments in the bundle. The variation is that the finer diameter filaments require a higher total solids in the aqueous chemical treating composition, since the surface area of the finer diameter filaments is higher.

In addition, an optional component of the aqueous chemical coating composition can be one or more aqueous emulsifiable or dispersible waxes. The type and amount of wax is that which is effective to serve as an adhesion promoter for the matrix coating that will be applied to fabrics made from the flexible bundle of filaments. In addition, the type and amount of wax can be effective to provide a screen effect against ultraviolet degradation when the fabric or polymer coated fabric is not protected from the weather or the environment. Also the wax may modify the frictional properties of the impregnated bundles of filaments. The one or more waxes can be dispersed or emulsified in water with any suitable emulsifiers known to those skilled in the art. The one or more waxes can be included in the aqueous impregnant composition in a preemulsified or predispersed form. The preferred wax materials are the microcrystalline wax materials and suitable examples of commercially available predispersed forms include Polymekon SPPW-40 microcrystalline wax available from Petrolite Corporation-Bareco Division, Tulsa, Okla. This material is a hydrocarbon water dispersion with a 40 percent solids. Another suitable example is Mobilcer Q microcrystalline wax available from Mobil Chemical Company. This material is an acid type aqueous emulsion of microcrystalline wax, where the wax has a melting point of 160° F, and where the emulsion has an average particle size of 2 micron, and a solids content of 50.5 percent by weight, and an emulsion density of 7.9 and a pH of 6.8. Preferably the amount of wax present in the coating composition is in the range of up to about 5 weight percent of the aqueous impregnant composition. Any suitable solids and dispersants or emulsifiers having a suitable HLB value as known to those skilled in the art can be used to assist in emulsifying or dispersing the wax in water.

Also the aqueous impregnant composition can have one or more plasticizers which are soluble, emulsifiable or dispersible in water. The plasticizers are added in an effective amount to provide some plasticity to the ethylene-containing interpolymer. Preferably the amount of plasticizer present in the aqueous impregnant composition would be in the range of up to about 5 weight percent of the aqueous impregnant composition. The plasticizer is used, where the Tg of the interpolymer does not result in adequate flexibility of the impregnated bundle of filaments, to reduce the Tg and to achieve a more flexible impregnated bundle of filaments. Any suitable solvents and emulsifiers or dispersants having suitable HLB values as known to those skilled in the art can be used to emulsify or disperse the plasticizer in water. These emulsifiers can be nonionic, cationic or anionic and a particularly useful type of an emulsifier is the nonionic emulsifier such as polyoxyalkylene sorbitan monolaurate, commercially available under the trade designation Tween 21 emulsifier from ICI America. It is preferred that the plasticizers used should be flame retardant type plasticizers such as xylene triphosphate available under the trade designation Phosphlex 179®-A plasticizer available from Stauffer Chemical Company. This material is a liquid with a specific gravity at 20°/20° C. of 1.143, at density of pounds per gallon of 9.5, a boiling point at 10 millimeters of mercury of 265°–285° C., a pour point of 0° F., a viscosity at 100° F. SUS of 220 and a flashpoint of 455° F. COC. Also a phosphite chelator such as nonylated phenol phosphite can be emulsified or dispersed in the aqueous impregnant composition or preemulsified or predispersed and added to the aqueous impregnant composition. A suitable phosphite chelator is that which is available under the trade designation Mark 1178 from Argus Chemical Corporation, Brooklyn, N.Y. This material has a specific gravity of 0.99, and 0 percent volatiles. Another type of commercial plasticizer that could be used is an epoxidized soy bean oil like that commercially available under the trade designation Drapex 6.8 material. Any other aqueous soluble, emulsified or dispersible plasticizer known to those skilled in the art can be used in an effective plasticizing amount for the ethylene-containing interpolymer.

The aqueous treating composition can have present a diene-containing elastomeric polymer in conjunction with the aforedescribed ethylene-containing interpolymer. The diene-containing elastomer is water dispersible or emulsifiable with suitable solvents and emulsifiers known to those skilled in the art of elastomeric latices. This elastomeric material is preferably added to the aqueous impregnant composition as a latex in an effective flexibilizing amount to assist in flexibilizing the moisture reduced, partially cured residue of the aqueous impregnant composition to the desired flex modulus. Preferably the modulus at 100% elongation of a cast film of the aqueous impregnant composition is in the range of about 200 to 8,000 psi and most preferably, about 800 to about 5,000 psi. Such an aqueous impregnant composition when moisture-reduced and partially cured as an impregnant in the bundle of filament provides the desired flexibility. The amount of the elastomeric latex that is used is always an amount that will not interfere with the compatibilizing amount of the ethylene-containing interpolymer for compatibility with the polymeric matrix coating that subsequently coats any fabrics prepared from the flexible bundle of filaments. When the ethylene-containing interpolymer has present a polar copolymer which reduces the noncrystallinity of the interpolymer or increases the Tg of the interpolymer, the diene-containing elastomeric latex must be present in the coating composition. The diene-containing elastomeric latex is preferably essentially free of any vinyl pyrridine monomeric or repeating units in the polymer. The vinyl pyrridine tends to make the elastomer too stiff for increasing the flexibility of the moisture reduced, partially cured residue on the flexible bundle of filaments.

Nonexclusive examples of suitable diene-containing elastomers include: polybutadiene homopolymer, and carboxylated styrene-butadiene copolymers or any other non-selfcrosslinkable elastomer. The term non-selfcrosslinkable as used herein refers to a polymeric material that cannot undergo intramolecular or internal crosslinking with itself but can undergo intermolecular or external crosslinking with other materials. The intramolecular crosslinking means one part of the same molecule or polymeric chain crosslinks with another part of the same molecule or chain. Here, the term "chain" includes the polymeric backbone chain and pending groups. Suitable examples of non-selfcrosslinkable elastomers include: elastomeric reaction products formed by the reaction of 1,3-diene hydrocarbon monomers such as butadiene-1,3; isoprene; 2,3-dimethyl-1,3-butadiene, 2-2ethyl-1,3-butadiene and the like alone as homopolymers or in mixtures as interpolymers; or ethylene-propylene-diene rubbers (EPDM) produced in a suitable manner from such dienes as dicyclopentadiene, 5-ethylidene-2-norborene, 1,4-hexadiene,5-methylene-2-norborene interpolyermized with ethylene and an alpha-mono-olefin having from 3 to 20 carbon atoms such as propylene; nitrile rubber such as nitrile butadiene latex; or butyl rubber which is a commercial name for copolymers of isobutylene with small amounts of butadiene or isoprene or mixtures thereof. Another elastomer that may be used is chloroprene or neoprene. All of these elastomeric materials are preferably used in their latex form. The diene-containing elastomeric latex is always present in the aqueous impregnant composition when the polar comonomers for the ethylene-containing interpolymer is vinyl chloride, carbon monoxide, and vinyl fluoride. When polybutadiene homopolymer latex or similar materials are used, the amounts can range from less than 20 percent to greater than 40 percent based on the ethylene-containing interpolymer in the aqueous impregnant composition. Amounts less than 20 percent give diminished benefits in flexibility as the amount approaches 0. Amounts greater than 40 weight percent provide adequate flexibility but increase the amount of tackiness of the moisture-reduced, partially cured residue on the bundle of filaments. If alternative measures are not pursued in reducing such tackiness, then the amount of polybutadiene homopolymers should not be too much greater than 40 percent in order to maintain the less tacky nature of the impregnated flexible bundle of filaments. To assist in maintaining a less tacky nature to the film, the amount of styrene in a carboxylated styrene butadiene copolymer can be increased. Increasing the amount of styrene from about 60 weight percent to about 84 weight percent is an example of an approach to decreasing the tackiness of the resultant residue.

A nonexclusive example of a commercially available diene-containing elastomer latex that can be used includes a 1,3-polybutadiene homopolymer latex available under the trade designation "LPM-6290" from Goodyear Tire and Rubber Company having a total solids of 43 to 46 percent, a pH of 8 to 9.5, a maximum viscosity of 6,000 centipoise (RFT 1 at 20 rpm), a maximum coagulum of 0.05 percent max and a mechanical stability of 55 to 75 milligrams and surface tension of around 58 to 74 dynes per centimeter, and particle size in the range of 500 to 2,000 angstroms and a maximum gel content of 25 percent. Other nonexclusive examples of non-selfcrosslinkable elastomeric latices are those available from Polysar in Monaca, Pa. under the trade designation Dylex latex 55E having a percent volatiles by volume of 49 to 51 and a formula of $C_7H_6{=}CH_2{+}C_4H_6{+}CCHO_2$, and the Polysar carboxylated styrene butadiene latex having 84 percent styrene content.

The aqueous impregnant composition having present the ethylene-containing interpolymer and self-crosslinking material and water need not have present all of the optional ingredients such as the wax, plasticizer, and diene-elastomer except in regard to the presence of certain polar comonomers in the ethylene-containing interpolymer as aforementioned, and any pigments and/or dyes known to those skilled in the art of coloring textiles. It is preferred, when the diene elastomeric latex essentially free of vinyl pyrridine is not present, that the aqueous impregnant composition with the ethylene-containing interpolymer and self-crosslinking material and water also has present the crosslinking controlling agent as ammonium hydroxide, one or more dispersed waxes and one or more dispersed plasticizers. When the diene-containing elastomeric material essentially free of vinyl pyrridine is present in the coating composition, it is preferred to have present only one of each of the dispersed microcrystalline wax and dispersed plasticizer.

The aqueous impregnant composition can be prepared by adding all of the components sequentially or simultaneously to the desired volume of water with appropriate emulsifiers for any of the materials to be emulsified or dispersed in water. Preferably, the materials that are not water soluble are preemulsified or dispersed with suitable solvents and emulsifiers with appropriate HLB values as known to those skilled in the art and added to formulate the aqueous impregnant composition. Most preferably, the aqueous dispersion of the ethylene-containing interpolymer has added to it the aqueous dispersed plasticizers and the aqueous dispersed waxes. The self-crosslinking material in an aqueous medium is diluted and has added to it the ammonium hydroxide for controlling the rate of cross-linking, and this mixture is added to the aqueous mixture of interpolymer and plasticizer and/or wax. The diene-containing elastomeric latex is preferably added to the aqueous medium of the self-crosslinking material before it is added to the aqueous mixture of interpolymer, plasticizer and/or wax. The aqueous coating can be further diluted with water to achieve a desired volume of material to give the aqueous impregnant composition the total solids and viscosity required for impregnating the bundle of filaments.

The aqueous impregnant composition is applied to bundles of sized filaments, which includes bundles of strands, yarns both twisted and untwisted and bundles of monofilaments. The filaments have been sized during their formation to protect the filaments and to make them compatible with hydrophobic materials. When the filaments are glass fibers, the sizing is an aqueous sizing composition which has present at least a coupling agent to make the fibers less hydrophilic and a protectorant. The protectorant can be an aqueous soluble, dispersible or emulsifiable glass fiber lubricant or an aqueous soluble, dispersible or emulsifiable glass fiber film forming polymer. Any coupling agent, glass fiber lubricant or glass fiber film forming polymer known to those skilled in the art can be used. It is preferred that the sized glass filaments are essentially free of a starch film forming materials. A nonexclusive example of a suitable non-starch containing aqueous sizing composition for glass fibers is that disclosed in U.S. Pat. No. 4,390,647 (Girgis), which is hereby incorporated by reference. The application can be by dip coating or die coating or any other process known to those skilled in the art for applying coatings to groups of filaments. For example, the bundle of filaments can be dipped into a bath containing the aqueous impregnating composition or the bundle can contact a kiss roll or other applicator device that carried it to contact the bundle of filaments. Also a die coating arangement can be employed, where the bundle of filaments is pulled, pushed or stuffed through permanent or adjustable orifices. This operates effectively to open the strand immediately in advance of the orifice to expose the innermost regions of the glass fiber bundle to the liquid impregnant located in the container with the orifices. Before the bundle contacts the impregnant, it can ride over a bar or similar device under tension to spread the fibers in the bundle for maximum separation and better impregnation. The sized filaments have the sizing composition which does not provide too much integrity between the filaments when they are gathered into groups or bundles of filaments so that upon dip coating or die coating, the filaments separate somewhat one from the other to assist in allowing the coating composition to surround and enter the groups or bundles of filaments. The impregnation preferably is to a degree so that every filament in the bundle or in bundled strands has a substantial portion of its surface covered with the aqueous impregnant composition so that when the aqueous impregnant composition is dried and partially cured, the filaments in the bundles will be separated from each other.

The bundles of filaments with the treatment of the aqueous impregnant composition are dried to partially cure and reduce the moisture content of the aqueous impregnant composition. Any method known to those skilled in the art for curing crosslinkable materials may be used to dry and cure the impregnated bundle of filaments. It is preferred that the drying is a non-dielectric type drying and that the moisture is reduced to a moisture content in the range of less than around 1 to about 2 percent of the bundle. This and the partial curing are accomplished by drying at suitable temperatures and times to result in the desired moisture reduction and partial cure. Preferably, the drying is conducted at a temperature in the range of about 400° F. to about 500° F. (200°-260° C.) for a time in the range of about 10 seconds to about 60 seconds or any equivalent temperature and time relationship to accomplish a similar degree of moisture reduction and partial curing.

The partially cured impregnated bundle of filaments is flexible enough to undergo myriad fabric producing processes. Nonexclusive examples of fabric producing processes include weaving, nonwoven fabrics, knitted, braided, weft-knit fabrics such as those produced on the Mayer or Libya weft insertion fabric machine. On this type of machine, the fabric is a bi-directional crosslaid warp and weft structure, where the weft yarns do not interlace as in traditional woven fabrics. A "knit stitch" is run in the warp machine direction to lock the fabric together. For the weaving operation, plain weave, satin weave or any other type of weaving for producing a fabric as known to those skilled in the art can be used.

The fabric whether woven or nonwoven or knitted or braided can be coated with numerous types of coatings by myriad processes. Examples of suitable polymeric coatings include vinyl resins such as polyvinyl chloride, polyethylene and ethylene copolymers, polyurethanes, phenolic resins, melamine formaldehyde resins and elastomeric materials such as chlorosulfonated polyethylene, chlorinated polyethylene and polymers of ethylene propylene diene monomers and Hypalon® elastomers and silicone polymers.

These types of polymers can be coated onto fabrics of the flexible bundle of filaments by impregnation or saturation processes and surface coating processes such as solvent-containing coatings and 100 percent solids coatings and lamination processes of preformed films or sheets. For example, when a plastisol 100 percent solids coating is used, an application of a first coating of poly(-vinylchloride) latex is applied to the fabric to improve adhesion of subsequent plastisol coatings. After the application of the plastisol coating paste to the fabric, the fabric is heated to a temperature usually around 350° to 400° F. to permit the resin particles to form a continuous phase over the fabric and to actually contact in the interstices between the fabric. The polymeric coating then cools to a tough coherent film at room temperature. The fusion process is so quick that the coated fabrics may be cooled as soon as the required fusion temperature is obtained. In addition to the polymeric material, various pigments or fillers can be included and the polymeric materials may be modified by plasticizers and solvents.

The polymeric coating and preferably the polyvinyl chloride coating also can be applied by other coating processes known to those skilled in the art such as passing the fabric over a knife-over-roll coater. Also any wet coating process known to those skilled in the art can be used such as passing the fabric over sequential knife coaters or through a floating knife coater with a support channel. Also blanket knife coaters and inverted knife coaters and levelon coaters with reverse smoothing rolls can be used as can engraved-roll or rotogravure coating units. In applying the plastisols, any dry or 100 percent solids coating process known to those skilled in the art can be used. For instance, hot melt coating can be used or any modified wet coating process, where there is not any solvent evaporation. In addition, cast-coating techniques can be used as well as metal-belt precast coaters. Also a dry powder resin coating method such as hot calendar-coating and extrusion-coating can be used. Also wet lamination and dry lamination involving the union of the fabric with a film or sheet of the polymer, which has been formed in a separate operation, can be used. In the lamination processes, the film or sheet can be formed by calendaring, by extrusion, or by casting in a separate operation and laminated to the fabric base. With these processes an adhesive coating can be applied to the plastic sheet prior to the application of pressure against the fabric and plastic sheet or the plastic sheet can act as the thermoplastic adhesive itself and can be heated to produce the adhesion and afterwards brought into contact with the fabric while hot. The use of the adhesive application is performed in the multiple-ply drum lamination process. Also with foamable polymeric materials, the thermoplastic foam lamination process can be used.

FIG. 1 depicts a coated fabric of the present invention where numeral 12 shows the fabric comprised of the flexible impregnated bundle of filaments of the present invention and numerals 11 and 13 indicate the polyvinyl chloride sheets or films that are laminated together sandwiching the fabric in between the laminate sheets. Ordinarily, the thickness of the coated fabric ranges from even less than 0.010 to greater than 0.06 inch (0.025 cm–0.15 cm), and the amount of coating on a unit area of the fabric varies widely but it is usually is around 5 to about 50 ounce/yard$^2$ (119–1700 gm/m$^2$).

PREFERRED EMBODIMENT

In the preferred embodiment of the present invention, the filaments are glass fibers of any fiberizable glass composition such as "E-glass", "621-glass", "A-glass", "C-glass", and "S-glass", and any low or free boron and/or fluorine derivatives thereof. The most preferred glass composition is the "621-glass". The glass fibers are formed by attenuation from molten streams of glass issuing forth from orifices in a bushing of a glass batch melting furnace. After the filaments have cooled below the boiling point of water, an aqueous sizing composition is applied to the fibers. The aqueous sizing composition is a nonstarch textile size having a 50/50 blend of a polyalkylene polyol available under the trade designation Pluracol V-7 polyol and polyoxyalkylene polyol available under the trade designation Pluracol V-10 polyol from BASF Wyandotte. The amount of the blend is in the range of about 0.5 to about 5 weight percent of the aqueous treating composition and most preferably about 1 to about 3 weight percent. The silane coupling agent is preferably a lubricant modified amino silane coupling agent available under the trade designation Y-9072 silane. This material is present in an amount in the range of about 0.01 to about 2 weight percent of the aqueous treating composition. The preferred cationic lubricant is the polyamine lubricant commercially available as an acidified cationic fatty acid amide under the trade designation Emery 6760-U. This material is present in the aqueous treating composition in an amount of about 0.01 to about 4 weight percent of the aqueous treating composition. The total solids of the aqueous treating composition can be any convenient solids range for sizing compositions to be applied at a proper and desired LOI to glass fibers. Preferably the total solids is in the range of around 3 to around 20 weight percent. It is preferred to apply the aqueous treating composition to the glass fibers in such a manner to give an LOI for the glass fibers in the range of about 0.1 to about 1 percent and most preferably about 0.5 to about 0.8 percent.

The glass fibers treated with the aqueous nonstarch sizing composition are gathered into one or more strands preferably one strand, where the filament diameter can range from less than 5 microns to around 30 microns, but most preferably is in the range of around 5 microns to 15 microns. The strands are collected on forming packages and dried to reduce the moisture content of the aqueous sizing composition to around 0.1 to about 1 weight percent. One or more strands are coated with an aqueous impregnant composition having the following formulation:

| | | |
|---|---|---|
| Air Flex 410 | (vinylacetate/ethylene copolymer) (Air Products) | 10,000 g |
| Water | | 6,500 g |
| Polymekon SPPW-40 | (microcrystalline wax) (Petrolite Corporation - Bareco Division) | 400 g |
| Mark 1178 | (nonylated phenol phosphite) (Argus) | 50 g |
| Tween 21 | polyoxyethylene sorbitan monolaurate (ICI Americas) | 50 g |
| Phosflex 179 | (xylene triphosphate) (Monsanto) | 500 g |
| Myrj 52 | (polyoxyethylene stearate) (ICI Americas) | 75 g |
| Resimene | (melamine formaldehyde resin) (Monsanto) | 500 g |
| Dylex D-55E | (carboxylated SBR latex) | 1000 g |

-continued

| | | |
|---|---|---|
| | (Polysar) | |
| Water | | To result in a percent solids of 18 percent |

The aqueous sizing composition has a pH of 8.5 ± 0.5 and a viscosity of 4-5 centipoise.

The coating is performed preferably in a die coater and alternatively in a dip coating process. The total solids of the aqueous impregnant composition is in the range of around 8 to about 35 weight percent, most preferably around 15 to 35 weight percent. The coated bundle of fibers are dried to reduce the moisture content and to partially cure the aqueous impregnant composition which had a viscosity of around less than 10 centipoise at room temperature. The temperature of drying is in the range of 425° to 500° F. (218°-260° C.) for a period of time of 10-60 seconds. The amount of the dip coating on the bundle of filaments and impregnated into the bundle is around 4 to about 35 weight percent and most preferably around 9 to 30 weight percent depending on the fiber diameter of the glass fiber bundle. The coated bundle was collected as zero twist material and woven into a fabric. The material was then coated with a polyvinyl chloride plastisol coating in a calendaring process. The fabric is coated first with a very thin film of the vinyl plastisol under proper tension to set the weave structure. Several passes are made of this coated fabric through the coating line to accumulate a continuous film of about 0.02 (0.05 cm) to about 0.04 (0.1 cm) thick of polyvinylchloride polymer. The coated fabric is cured at around 260° F. (127° C.) under pressure for a few minutes, cooled to ambient temperature and packed on a roll.

The present invention and additional embodiments are further illustrated by the following examples.

Table 1 presents data on 11 aqueous coating formulations which were applied to sized glass fibers. The glass fibers had a filament diameter of around 13 microns (K-fibers). The fibers were sized with an aqueous sizing composition having a 50/50 blend of the polyalkylene polyol V-7 polyol and polyoxyalkylene polyol V-10 polyol in an amount of 758 grams for each in a 10 gallon mix. The polyoxyalkylene polyol was diluted with agitation with deionized hot water in an amount of around 50 percent of the total water used in the size. The hot water was at a temperature of around 140°-160° F. (60°-71° C.) with agitation in a premix tank. The mixture was agitated for 10 minutes and the solution was clear and the polyol was added to a main mix tank. The 758 grams of the polyalkylene polyol were added directly to the main mix tank. Hot deionized water in an amount of around 20 percent of the total water in the aqueous sizing composition was added to a premix tank and the glass fiber lubricant was added in an amount of about 290 grams and agitated for around 10 minutes and the mixture was transferred to the main mix tank. The lubricated silane was added in an amount of 290 grams to the main mix tank. The aqueous sizing composition was then diluted to the final volume of 10 gallons with deionized water and agitated for around 10 minutes before sampling. These fibers were then treated with the aqueous impregnant compositions of Table 1 in a dip coating process and the coated bundles of filaments were constructed into a K-15 1/0 product, where one bundle had around 1,000 filaments.

In addition to the strand constructions of the preferred embodiment, a bundle construction of G-75 5/0 strands can also be utilized. The G-fibers characteristically have a diameter of 9.53±0.63 microns and in the G-75 construction, have 2,000 filaments in a bundle, which is constructed of 5 strands, each strand having 400 filaments. Also a single bundle of around 3,000 or more filaments can be impregnated and used as the flexible impregnated bundle of filaments of the present invention.

A number of impregnated yarns produced with the coating compositions of Table 1 were tested according to the tests in Table 2. The breaking strength test for original samples, samples aged in humidity for 14 days and samples subjected to 120° F. at 98 percent relative humidity for 28 days and samples water aged at room temperature for 28 days and the flex resistance tests with the MIT flex folding test for samples that were original, humidity aged at 28 days, and water aged at 28 days were performed in accordance with standard test methods for breaking strength and flex resistance. Unimpregnated yarns of sized glass fibers that were sized with the aqueous sizing composition of the preferred embodiment were tested for original breaking strength and flex properties, and the yarns gave values from 35.5 and 60 cycles respectively. The specimens tested in Table 2 were conditioned at 78° F. (26° C.) and 55 percent relative humidity for 24 hours before testing to simulate some storage conditions. For the flex folding test of Table 2, a 0.125 lb load was used with a 0.03 inch (0.08 cm) mounting head with a single strand being tested. As shown in Table 2, the coating compositions impregnating the bundles of filament of the present invention have improved flex properties.

TABLE 1

| | Example 1 gms/wt % Solids | Example 2 gms/wt % Solids | Example 3 gms/wt % Solids | Example 4 gms/wt % Solids |
|---|---|---|---|---|
| Ethylene vinyl acetate copolymer (Air Flex 410 copolymer 47-55% solids) | 10,000/72.6 | — | — | — |
| Ethylene/vinyl acetate/vinyl chlorine terpolymer (Air Flex 728 terpolymer) | — | 7175/71.5 | 7175/62.9 | 7175/52.3 |
| Water 52% | 6,500 | 3,500 | 3,500 | 3,500 |
| Microcrystalline wax (Petrolite Corp.) 40% solids | 400/2.3 | 90/.7 | 90/.6 | 90/.6 |
| Molbilcer Q (50.5 solids) | 430/3.1 | 430/4.2 | 430/3.7 | 430/3.4 |
| Water | — | — | — | — |
| Nonylated phenol phosphite (Mark 1178 Argus) | 50/0.7 | 36/.6 | 36/.6 | 36/.6 |
| Polyoxyethylene sorbitan monolaurate (Tween 21) | 50/0.7 | 26/.5 | 26/.4 | 26/.4 |
| Xylene triphosphate (Phosflex) | 500/0.7 | — | — | — |

TABLE 1-continued

| | | | | |
|---|---|---|---|---|
| Polyoxyethylene stearate | | | | |
| Myrj 52 | 75/1.1 | 50/1 | 50/.8 | 50/.8 |
| Hot water | — | 60 | 60 | 60 |
| Cold water | — | 1435 | 1435 | 1435 |
| $NH_4OH$ (28% solids) | 15/.06 | 36/.2 | 36/.2 | 36/.2 |
| Melamine formaldehyde resin (65% solids) | 500 | 360/4.5 | 360/3.9 | 360/3.7 |
| Water | 4.7 | — | — | — |
| Epoxidized soybean oil (Drapex 6.8%) | — | 160/3.1 | 160/2.7 | 160/2.5 |
| Polybutadiene latex | — | 1435/13.8 | 2870/24.2 | 2870/22.8 |
| Carboxylated styrene butadiene latex | | | | |
| Dylex 55% styrene | 1000/7.3 | — | — | 717.5/5.7 |
| Dylex 84% styrene | — | — | — | — |
| % Solids by Weight | 20 | 20 ± 5 | 20 ± 5 | 20 ± 5 |
| Viscosity (cps) | 4–5 | 4–5 | — | — |
| Total Volume | 34 L/9 gal | 19 L/5 gal | 19 L/5 gal | 19 L/5 gal |

| | Example 5 gms/wt % Solids | Example 6 gms/wt % Solids | Example 7 gms/wt % Solids | Example 8 gms/wt % Solids |
|---|---|---|---|---|
| Ethylene vinyl acetate copolymer (Air Flex 410 copolymer 47–55% solids) | 7175/73 | 7175/70 | 7175/51.8 | — |
| Ethylene/vinyl acetate/vinyl chlorine terpolymer (Air Flex 728 terpolymer) | — | — | — | 10,400/76.2 |
| Water | 3,500 | 3,500 | 3,500 | 10,400 |
| Microcrystalline wax (Petrolite Corp.) 40% solids | 90/1.8 | 90/.7 | 90/.5 | 468/2.6 |
| Mobilcer Q (50.5 solids) | 430/4.4 | 430/4.2 | 430/3.1 | — |
| Water | — | — | — | — |
| Nonylated phenol phosphite (Mark 1178 Argus) | 36/.7 | 36/.7 | 36/.5 | 416/5.8 |
| Polyoxyethylene sorbitan monolaurate (Tween 21) | 26/.5 | 26/.5 | 26/.3 | 52/.7 |
| Xylene triphosphate (Phosflex) | — | — | — | — |
| Polyoxyethylene stearate | | | | |
| Myrj 52 | 50/1 | 50/1 | 50/.7 | 78/1 |
| Hot water | 60 | 60 | 60 | 60 |
| Cold water | 1435 | 1435 | 1435 | 1300 |
| $NH_4OH$ (28% solids) | 36/.2 | 36/.2 | 36/.1 | 52/.2 |
| Melamine formaldehyde resin (65% solids) | 360/4.8 | | 360/4.6 | 360/3.4 |
| Water | — | — | — | — |
| Epoxidized soybean oil (Drapex 6.8%) | 160/3.2 | 160/3.1 | 160/2.3 | — |
| Polybutadiene latex | 1435/14.6 | 1870/18.2 | 2870/20.7 | — |
| Carboxylated styrene butadiene latex | | | | |
| Dylex 55% styrene | — | — | 717./5.2 | 1040/7.3 |
| Dylex 84% styrene | — | — | — | — |
| Total Solids (% by weight) | 20 ± 5 | — | 20 ± 5 | 18.9 |
| Viscosity (cps) | — | — | 4–5 | 4–5 |
| Total Volume | 19 L/5 gal | 19 L/5 gal | 19 L/5 gal | 37.6/10 gal |

| | Example 9 gms/wt % Solids | Example 10 gms/wt % Solids | Example 11 gms/wt % Solids |
|---|---|---|---|
| Ethylene vinyl acetate copolymer (Air Flex 410 copolymer 47–55% solids) | 10,000/81.2 | 10,000/81.2 | 7175/82.3 |
| Ethylene/vinyl acetate/vinyl chlorine terpolymer (Air Flex 728 terpolymer) | — | — | — |
| Water | 6,500 | 6,500 | — |
| Microcrystalline wax (Petrolite Corp.) 40% solids | 400/2.6 | 400/2.6 | 90/.8 |
| Mobilcer Q 50.5 solids | — | — | 430/.5 |
| Water | — | — | 3,500 |
| Nonylated phenol phosphite (Mark 1178 Argus) | 50/.8 | 50/.8 | 36/.8 |
| Polyoxyethylene sorbitan monolaurate (Tween 21) | 50/.8 | 50/.8 | 26/.6 |
| Xylene triphosphate (Phosflex) | — | — | — |
| Polyoxyethylene stearate | | | |
| Myrj 52 | 75/1.2 | 75/1.2 | 50/1.1 |
| Hot water | — | — | 60 |
| Cold water | — | — | 1435 |
| $NH_4OH$ (28% solids) | — | — | 36/.2 |
| Melamine formaldehyde resin (65% solids) | 645/5.9 | 500/5.3 | 500/5.3 |
| Water | 7,800 | — | — |
| Epoxidized soybean oil (Drapex 6.8%) | — | — | 160/3.7 |
| Polybutadiene latex | — | — | — |
| Carboxylated styrene butadiene latex | | | |
| Dylex 55% styrene | 1000/8.1 | — | — |
| Dylex 84% styrene | — | 1000/8.1 | — |
| Total Solids (% by weight) | 18 | 18 | 23 |
| Viscosity (cps) | 4–5 | 4–5 | 4–5 |
| Total Volume | 34 L/9 gal | 34 L/9 gal | 19 L/5 gal |

TABLE 2

| EVALUATION OF EXPERIMENTAL VINYL COATED YARNS TENSILE AGING STUDY | | | | | | FATIGUE RESISTANCE STUDY - MIT FLEX FOLDING TEST NUMBER OF CYCLES TO FAILURE | | |
|---|---|---|---|---|---|---|---|---|
| | | | HUMIDITY AGED; 120° F. & 98% RH | | WATER AGED, RT | | HUMIDITY AGED:* | WATER AGED: |
| YARN NO. | LOI | ORIGINAL | 14 DAYS | 28 DAYS | 28 DAYS | ORIGINAL | 28 DAYS | 28 DAYS |
| Ex 1 | 12 | 66.0 | — | 66.2 | 66.0 | 701 | 759 | 698 |
| Ex 2 | 12 | 56.9 | 46.5 | 47.5 | 51.0 | NA | 451 | 397 |
| Ex 3 | 12 | 56.0 | 47.6 | 48.1 | 53.3 | 351 | 307 | 282 |
| Ex 5 | 12 | 51.9 | 47.9 | 41.3 | 46.4 | 437 | 346 | 336 |
| Ex 6 | 12 | 63.1 | 58.5 | 59.1 | 63.6 | 792 | 675 | 741 |
| Ex 7 | 12 | 68.0 | 64.5 | 62.8 | 67.3 | 1083 | 1017 | 932 |
| Ex 9 | 12 | — | — | — | — | 948 | — | — |
| Ex 10 | 12 | — | — | — | — | 1100 | — | — |
| Ex 11 | 12 | 65.9 | 54.1 | 59.6 | 53.6 | 501 | 752 | 811 |

*Aged at 120° F. and 98% Relative Humidity

We claim:

1. A flexible bundle of sized filaments coated and impregnated with a moisture-reduced, partially cured residue of an aqueous chemical coating composition, where the composition, comprises:

a. water dispersible or emulsifiable elastomeric ethylene-containing interpolymer formed from ethylene monomer and one or more polar comonomers selected from the group consisting essentially of vinyl acetate, methyl acrylate, ethyl acrylate, styrene, alpha methyl styrene, methyl methacrylate, acrylamide, methacrylate, n-methyl-N-vinyl acetamide, diethyl fumaric, diethyl maleate, n-vinyl pyrrolidone, n-vinyl succinimide, vinyl chloride, carbon monoxide, and vinyl fluoride, where the ethylene-containing interpolymer is present in the coating and impregnant composition in an effective compatibilizing amount, and in a predominant amount of the solids of said composition, b. self-crosslinking resinous material in an effective amount to provide partial curing of the residue and to reduce the development of tackiness of the residue on the surface of the coating bundles, c. an aqueous dispersible or emulsifiable diene-containing elastomer, that is essentially free of vinyl pyrridine repeating units, and d. water in a predominant amount of the aqueous chemical coating and impregnant composition.

2. Flexible filamentary bundles of claim 1 having an effective amount of crosslinking controlling agent.

3. Flexible filamentary bundles of claim 1, wherein the aqueous impregnant composition has one or more aqueous emulsifiable or dispersible plasticizers.

4. A flexible, filamentary bundle of claim 3, wherein the aqueous emulsifiable or dispersible plasticizers are epoxidized soy bean oil, xylene triphosphate amulsified with polyoxyethylene stearate and nonylated phenol phosphite emulsified with polyoxyethylene sorbitan monolaurate.

5. Flexible filamentary bundle of claim 1, wherein the aqueous chemical coating and impregnant composition has one or more aqueous emulsifiable or dispersible microcrystalline waxes.

6. Flexible filamentary bundle of claim 5, wherein the aqueous emulsifiable or dispersible microcrystalline waxes are hydrocarbon aliphatic waxes in an aqueous medium.

7. Flexible filamentary bundle of claim 1, wherein the aqueous chemical coating and impregnant composition has a total solids content and viscosity in effective impregnating amounts.

8. A flexible filamentary bundle of claim 1, wherein the filaments are glass fibers.

9. A flexible bundle of sized filaments of claim 1, where the aqueous dispersion or emulsifiable elastomeric ethylene-containing interpolymer is produced with ethylene monomer and with one or more polar comonomers, where the polar comonomer is present in an amount of at least around 25 mole percent of the copolymer.

10. The flexible bundle of filaments of claim 9, wherein the elastomeric ethylene-containing interpolymer is an ethylene vinyl acetate copolymer having an amount of vinyl acetate of from about 45 to 80 weight percent of the copolymer, and an amount of ethylene repreating units to have a glass transition temperature for the copolymer of around 0° C. or less.

11. Flexible bundle of filaments of claim 9, wherein the self-crosslinkable methylene donor condensate resin is selected from the group consisting of resorcinol formaldehyde resins, phenol formaldehyde resins, melamine formaldehyde resins and mixtures thereof.

12. Flexible bundle of filaments of claim 9, wherein the self-crosslinkable methylene donor condensate resin is present in an amount of about 3 to about 10 weight percent of the aqueous chemical coating and impregnant composition.

13. Flexible bundle of filaments of claim 9, wherein the diene-containing elastomer is selected from the group consisting of polybutadiene homopolymer and carboxylated styrene butadiene copolymers.

14. Flexible bundle of filaments of claim 9, wherein the diene-containing elastomer is present in an amount of about 5 to about 10 weight percent of the aqueous chemical coating and impregnant composition.

15. Flexible bundle of filaments of claim 9, wherein the water is present in an amount to give a total solids for the aqueous chemical coating and impregnant composition in the range of about 8 to about 35 and a viscosity in the range of about 1.5 to about 10 centipoise.

16. Flexible bundle of filaments of claim 9, wherein the aqueous chemical coating and impregnant composition includes one or more aqueous dispersible or emulsifiable waxes in an effective adhesion promoting amount.

17. Flexible bundle of filaments of claim 9, wherein the aqueous chemical coating and impregnant composition includes a crosslinking controlling agent.

18. Flexible bundle of filaments of claim 9, wherein the crosslinkable control agent is ammonium hydroxide.

19. Flexible bundle of filaments of claim 9, wherein the aqueous chemical coating and impregnant composition further comprises one or more aqueous emulsifiable or dispersible plasticizers.

20. Flexible bundle of filaments of claim 9, wherein the filaments are glass fibers.

21. Flexible bundle of glass fibers, comprising:

a. a plurality of glass fibers constituting a bundle, wherein the fibers have a moisture-reduced residue of an aqueous treating composition present on a substantial portion of all of the fibers in the bundle, wherein the aqueous treating composition has one or more coupling agents and one or more glass fiber protectorants and water, and b. a moisture-reduced, partially cured residue of an aqueous chemical coating and impregnant composition covering and impregnating the bundle of filaments so that a majority of the filaments in the bundle have a substantial portion of their surfaces already having the first moisture reduced residue covered with the second moisture-reduced residue, wherein the aqueous chemical coating and impregnant composition has a modulus at 100% elongation of a cast film in the range of about 200 to about 8,000 psi and has:

i. an aqueous emulsifiable and dispersible elastomeric ethylene vinyl acetate copolymer, wherein the weight percent of the vinyl acetate comonomer is about 50 to 80 weight percent of the copolymer and the weight percent of ethylene is sufficient to reduce the glass transition temperature of the copolymer to 0° C. or less, and wherein the copolymer is present in a predominant amount of the solids of the aqueous coating and impregnating composition, ii. aqueous dispersible or emulsifiable microcrystalline wax, in an amount up to around 5 weight percent of the aqueous coating and impregnating composition, iii. one or more aqueous dispersible or emulsifiable plasticizers in an amount up to around 5 weight percent of the aqueous coating and impregnating composition, iv. melamine formaldehyde resin present as a self-crosslinking material in an effective amount to at least partially cure the moisture reduced residue of the aqueous coating and impregnating composition, v. aqueous emulsifiable or dispersible diene-containing elastomers selected from the group consisting of polybutadiene homopolymers and carboxylated styrene butadiene copolymers, that is present in a non-interfering amount with the compatibilizing amount of the ethylene-containing copolymer, vi. water is an amount to give a total solids for the aqueous coating and impregnating composition in the range of about 8 to about 32 and a viscosity in the range of less than 10 centipoise at room temperature.

22. Flexible bundle of glass fibers of claim 21, wherein at least one of the plasticizers in the aqueous impregnant composition is flame retardant plasticizer.

23. Polymeric coated fabric constructed from the bundles of filaments of claim 22.

24. Polymeric coated fabric constructed from the bundles of filaments of claim 9.

25. Polymeric coated fabrics constructed from flexible bundles of sized filaments coated and impregnated with a moisture-reduced, partially cured residue of an aqueous chemical coating and impregnant composition, where the composition, comprises:

a. a water dispersible or emulsifiable elastomeric ethylene-containing interpolymer formed from ethylene monomer and one or more polar comonomers selected from the group consisting essentially of vinyl acetate, methyl acrylate, ethyl acrylate, styrene, alpha methyl styrene, methyl methacrylate, acrylamide, methacrylate, n-methyl-N vinyl acetamide, diethyl fumaric, diethyl maleate, n-vinyl pyrrodidone, n-vinyl succinimide, vinyl chloride, carbon monoxide, and vinyl fluoride, where the ethylene-containing interpolymer is present in the coating and impregnant composition in an effective compatibilizing amount and in a predominant amount of the solids of said composition, b. self-crosslinking resinous material in an effective amount to provide partial curing of the residue and to reduce the development of tackiness of the residue on the surface of the coated bundles, c. an aqueous dispersible or emulsifiable diene-containing elastomer, that is essentially free of vinyl pyrridine repeating units, and d. water in a predominant amount of the aqueous chemical coating and impregnant composition.

26. Flexible bundle of glass fibers of claim 21, wherein the moisture-reduced residue of an aqueous treating composition present on a substantial portion of all of the fibers in the bundle has a silane coupling agent which is a lubricant modified gamma-aminopropyltriethoxy silane in an amount in the range of about 0.01 to about 2 weight percent of the aqueous treating composition, and a cationic lubricant which is a polyamine lubricant that is an acidified cationic fatty acid amide present in an amount in the range of about 0.01 to about 4 weight percent of the aqueous treating composition, and a 50/50 blend of a polyalkylene polyol and a polyoxyalkylene polyol, wherein the blend is present in an amount of about 0.5 to about 5 weight percent of the aqueous treating composition where the moisture-reduced residue present on the fibers is present in an amount in the range of about 0.1 to about 1 weight percent LOI of the bundle.

27. Flexible bundle of glass fibers of claim 21, wherein the amount of the aqueous chemical coating and impregnating composition present on and in the bundle is in the range of about 4 to about 35 weight percent.

28. Flexible bundle of glass fibers of claim 21, wherein the aqueous chemical coating and impregnating composition has present a crosslinking controlling agent in an effective amount which in conjunction with the amount of the melamine formaldehyde resin self-crosslinking material achieves partial curing of the residue of the aqueous coating and impregnant composition.

29. Flexible bundle of glass fibers of claim 21, wherein the moisture-reduced partially cured residue of the aqueous chemical coating and impregnating composition has a moisture content in the range of less than around 1 to about 2 percent of the bundle.

30. Flexible bundle of glass fibers of claim 21, wherein the aqueous chemical coating and impregnant composition has the diene-containing elastomers present in an amount in the range of about 20 to about 40 percent based on the ethylene-containing interpolymer in the aqueous coating and impregnant composition.

31. Polymeric coated fabrics of claim 25, wherein the polymeric material is a polyurethane polymer.

* * * * *

UNITED STATES PATENT AND TRADEMARK OFFICE

CERTIFICATE OF CORRECTION

PATENT NO. : 4,663,231

DATED : May 5, 1987

INVENTOR(S) : Mikhail M. Girgis and Ernest L. Lawton

It is certified that error appears in the above-identified patent and that said Letters Patent is hereby corrected as shown below:

Column 19, line 22, 'comprises' should be "comprising";

Column 19, line 53, 'amulsified' should be "emulsified".

Signed and Sealed this

Twenty-seventh Day of September, 1988

*Attest:*

DONALD J. QUIGG

*Attesting Officer*

*Commissioner of Patents and Trademarks*